US005248055A

United States Patent [19]

Sanai et al.

[11] Patent Number: 5,248,055

[45] Date of Patent: Sep. 28, 1993

[54] STORAGE MODULE FOR EXPLOSIVES

[75] Inventors: Mohsen Sanai, Palo Alto; Gary R. Greenfield, San Jose, both of Calif.

[73] Assignee: SRI International, Menlo Park, Calif.

[21] Appl. No.: 879,057

[22] Filed: Apr. 30, 1992

Related U.S. Application Data

[63] Continuation-in-part of Ser. No. 645,231, Jan. 24, 1991.

[51] Int. Cl.[5] ..... B65D 25/14; B65D 45/00; B65D 51/16; F42B 39/20

[52] U.S. Cl. ..... 220/327; 220/325; 220/203; 220/208; 220/366; 220/89.2; 206/3

[58] Field of Search ..... 220/327, 325, 203, 208, 220/209, 366, 89.2, 261, 89.1; 89/30, 36.01; 109/1 V, 49.5, 84; 206/3

[56] References Cited

U.S. PATENT DOCUMENTS

| | | | |
|---|---|---|---|
| 1,579,270 | 4/1926 | Willoughby | 220/327 |
| 1,665,368 | 4/1928 | Joy | 220/327 |
| 1,729,085 | 9/1929 | Pofeldt | 220/89.2 |
| 1,749,122 | 3/1930 | Beasley | 220/327 |
| 1,894,652 | 1/1933 | Willoughby | 220/325 |
| 2,037,707 | 4/1936 | Davis et al. | 220/327 X |
| 2,346,700 | 4/1944 | Parsons et al. | 206/3 |
| 2,563,946 | 8/1951 | Law | 222/538 |
| 2,721,652 | 10/1955 | Lyon | 206/3 |
| 2,917,927 | 12/1959 | Clark | 73/432 |
| 3,115,281 | 12/1963 | Somme | 220/327 X |
| 3,160,062 | 12/1964 | Moy et al. | 206/3 |
| 3,187,929 | 6/1965 | Shaw, Jr. | 220/327 |
| 3,197,218 | 7/1965 | Coulter | 220/327 X |
| 3,279,645 | 10/1966 | Harvey | 220/55 |
| 3,498,493 | 3/1970 | Kemp | 220/325 |
| 3,608,769 | 9/1971 | Gablin | 220/325 X |
| 3,786,955 | 1/1974 | Mowatt-Larssen | 220/327 |
| 3,786,956 | 1/1974 | Tabor | 220/63 R |
| 3,999,379 | 12/1976 | Le Febvre | 220/89.2 X |
| 4,055,247 | 10/1977 | Benedick et al. | 206/3 |
| 4,101,029 | 7/1978 | Feinberg et al. | 220/327 X |
| 4,109,819 | 8/1978 | Kushman et al. | 220/208 |
| 4,135,640 | 1/1979 | MacQuilkin et al. | 220/316 |
| 4,347,929 | 9/1982 | Poe et al. | 206/3 |
| 4,411,372 | 10/1983 | Basterfield et al. | 220/327 |
| 4,432,285 | 2/1984 | Boyars et al. | 109/49.5 |
| 4,494,666 | 1/1985 | Cooper et al. | 220/327 X |
| 4,979,632 | 12/1990 | Lee | 220/327 X |
| 5,092,483 | 3/1992 | McKelvy | 220/327 |
| 5,121,852 | 6/1992 | Wickes | 220/366 |

OTHER PUBLICATIONS

Alvy, R. R., *Vessel Design for Explosive Mixtures* (HN 4-953.5), Holmes & Narver, Inc.: Anaheim, Calif., Apr., 1974, pp. 1-1-5-1.

Glenn, L. A., "Explosive Containment with Spherically-Tamped Powders", *Journal of Applied Physics*, vol. 60, No. 10, Nov. 15, 1986, pp. 3482-3488.

*Primary Examiner*—Allan N. Shoap
*Assistant Examiner*—Vanessa Caretto
*Attorney, Agent, or Firm*—John S. Bell

[57] ABSTRACT

A storage container or module for explosives is described comprising a cylindrical storage body, a cover, and yieldable means which retain the cover to the storage body while permitting the formation of a passage between the storage body and the cover to vent gases during a detonation within the container. In a preferred embodiment, the storage module is sized to permit storage of up to about 6 pounds of explosives without causing a sympathetic detonation in an adjoining module. The storage container is capable of quickly venting gases produced by a detonation due to the combination of a plurality of peripheral latching means spaced around an open end of the cylindrical storage body to engage both the body and a cover member, threads on a central shaft in the storage body which extends through an opening in the cover member to permit engagement of the threaded shaft with an internally threaded handwheel located on the outside of the cover member to centrally urge the cover member against the cylindrical storage body, and one or more O-ring seals between the cylindrical body and the removable cover member. This yieldable combination of peripheral and central closing and latching mechanisms, together with the O-ring seals, permits the cover and cylindrical body of the storage container to sufficiently separate during a detonation to form a passage through which gases within the container may be rapidly vented to prevent a build-up of excessive pressure in the container.

5 Claims, 4 Drawing Sheets

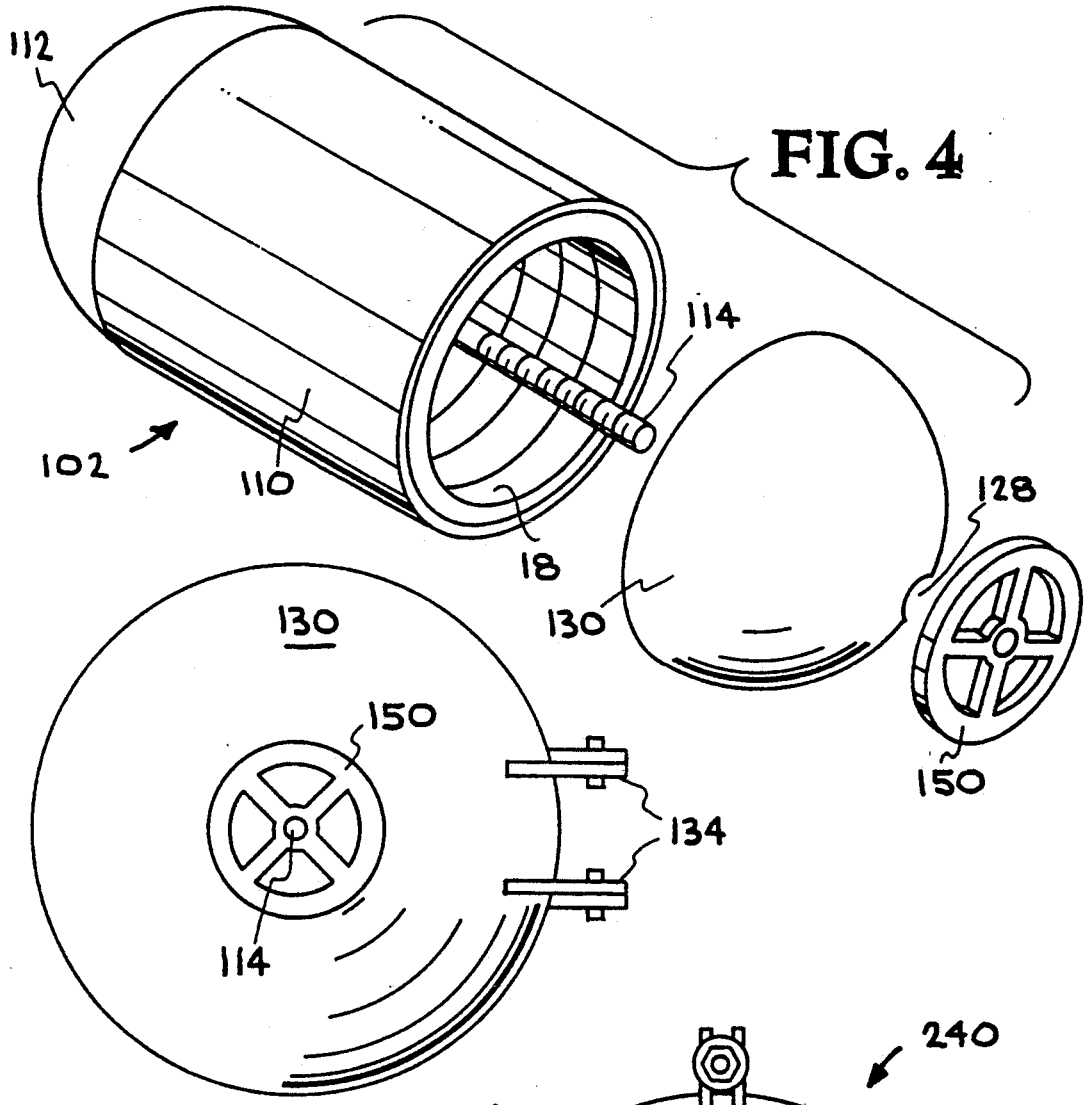
FIG. 4
FIG. 5
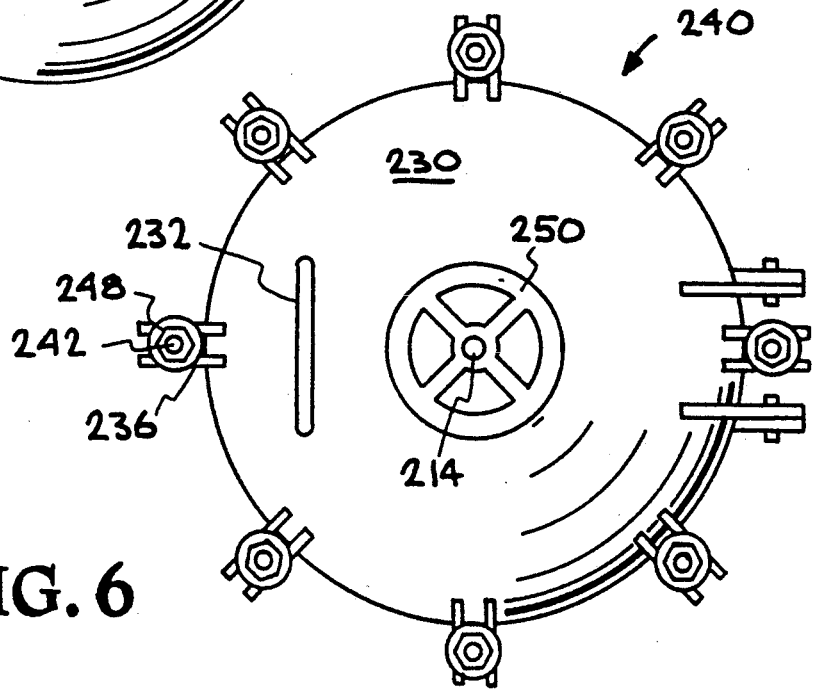
FIG. 6

STORAGE MODULE FOR EXPLOSIVES

This is a continuation-in-part of copending application Ser. No. 07/645,231, filed on Jan. 24, 1991.

BACKGROUND OF THE INVENTION

1. Field of the Invention

This invention relates to a container for the storage and transport of explosives.

2. Description of the Related Art

The safe storage and transport of explosive materials is an ongoing problem which has resulted in many different proposed designs to either completely contain a detonation via a vessel capable of withstanding high pressures, or to ameliorate the effects of such a detonation by providing a vessel which will at least partially vent or absorb the pressures developed in such a detonation. As an example of the first type of design, Harvey U.S. Pat. No. 3,279,645 describes a flanged pressure vessel and a flanged cover which is bolted to the pressure vessel either through the respective flanges or through reinforcing rings positioned around the respective flanges.

Tabor U.S. Pat. No. 3,786,956 shows a container for explosives which is capable of at least partially absorbing a detonation by forming the walls of the container from a number of laminations. In addition, explosives placed within the container are spaced from contact with the outer walls of the container by a support structure which may comprise a net or non-fragmenting materials such as plastic foam or foam rubber, which act to further absorb shock waves generated by a detonation.

Benedick et al. U.S. Pat. No. 4,055,247 also describes an explosion containment device capable of absorbing a detonation through the provision of an inner layer of distendable material which encloses the explosive, a continuous inner wall of steel surrounding the distendable material, a crushable layer around the continuous inner steel wall, and an outer steel wall.

Boyars et al. U.S. Pat. No. 4,432,285 describes a vessel for the storage of an explosive device comprising a bucket-shaped member having a wall structure formed of three metal layers with foamed plastic between the layers. A lid is formed of only foamed plastic so that the shock wave of any explosion will be directed toward the lid.

Poe et al. U.S. Pat. No. 4,347,929 describes a container for blasting caps which provides both absorption as well as pressure relief. The container comprises a cylindrical container with a screw-on door member that has corresponding buttress threads. The interior of the container is provided with an insert of a fragile foam or other absorptive material. The container also is provided with a vent mechanism comprising an opening through the wall of the container with a screw-in valve to permit gases produced during a detonation to escape at a low pressure.

Clark U.S. Pat. No. 2,917,927 discloses an explosion chamber which is provided with a relief valve which will open when the pressure in the chamber reaches a predetermined level.

MacQuilkin et al. U.S. Pat. No. 4,135,640 discloses a safety closure for a pressure vessel wherein a cover is bolted to the pressure vessel and a dome which fits over the cover shields the bolts. The dome has a bracket which engages a pressure relief valve to secure the dome over the bolts until the pressure relief valve has been opened so that the bolts cannot be accessed to open the cover until the pressure in the vessel has been vented.

Basterfield et al U.S. Pat. No. 4,411,372 discloses a pressure vessel with a cover having a groove formed therein to receive an 0-ring seal. The cover is secured to the vessel by hooks and bolts which permit the cover to move away from the container sufficiently to permit excess pressure to blow off when nuts on the bolts are slackened. However, the cover cannot be removed without rotating the cover with respect to the pressure vessel.

However, there still remains a need for a storage vessel for explosives wherein any detonation will be at least partially contained or absorbed, while the buildup of pressure is prevented by a pressure relief system wherein the extent and speed of the pressure relief is proportional to the pressure generated by the detonation.

SUMMARY OF THE INVENTION

It is, therefore, an object of this invention to provide a vessel for the storage and transport of explosives with minimal risk.

It is another object of the invention to provide a vessel for the storage and transport of explosives having a cover secured and sealed to the vessel by means capable of yielding to permit venting of high pressures developed in the vessel during a detonation. The term yield is used herein as it is conventionally used in mechanical engineering and materials engineering to means a deformation or change in shape such as a bending or stretching accompanying or occurring due to stress created in a material in response to an application of an external force. It is a specific object of this invention to provide clamping means having a yield strength whereat the pressure or force created by a detonation of predetermined magnitude within the container will cause a plastic deformation of the clamping means that permanently changes its length or other dimension. This deformation permits formation of a vent passage, but does not break or cause the clamping means to fail.

It is yet another object of the invention to provide a vessel for the storage and transport of explosives having a cover secured and sealed to the vessel by peripheral clamping means and seal means capable of yielding to permit venting of high pressures developed in the vessel during a detonation.

It is still another object of the invention to provide a vessel for the storage and transport of explosives having a cover secured and sealed to the vessel by central retention means and seal means capable of yielding to permit venting of high pressures developed in the vessel during a detonation.

It is a further object of the invention to provide a vessel for the storage and transport of explosives having a cover secured and sealed to the vessel by a combination of central retention means, peripheral clamping means, and seal means capable of yielding to permit venting of high pressures developed in the vessel during a detonation.

It is still a further object of the invention to provide a vessel for the storage and transport of explosives having a cover secured and sealed to the vessel by means capable of yielding to permit venting of high pressures developed in the vessel during a detonation and also containing absorption means within the vessel to at least partially absorb portions of the detonation.

These and other objects of the invention will be apparent from the following description and accompanying drawings.

BRIEF DESCRIPTION OF THE DRAWINGS

FIG. 4 is an exploded isometric view of a second embodiment of the invention.

FIG. 5 is a top view of the embodiment shown in FIG. 4.

FIG. 6 is a top view of the preferred embodiment of the invention which comprises a combination of the first two embodiments.

DETAILED DESCRIPTION OF THE INVENTION

Turning now to FIGS. 1-3A and 3B, one embodiment of the storage module for explosives of the invention is generally indicated at 2 comprising a metal cylinder 10 to one end of which is welded a domed bottom end member 12. Domed bottom end member 12 is generally hemiellipsoidal and preferably hemispherical in shape.

A central shaft 14, welded at 16 to domed bottom 12, extends coaxially through cylinder 10. Central shaft 14, in this embodiment, may be used to store spools of explosives such as spools of mild detonating fuse (MDF) or flexible linear shaped charge (FLSC) explosives.

Figure 1:
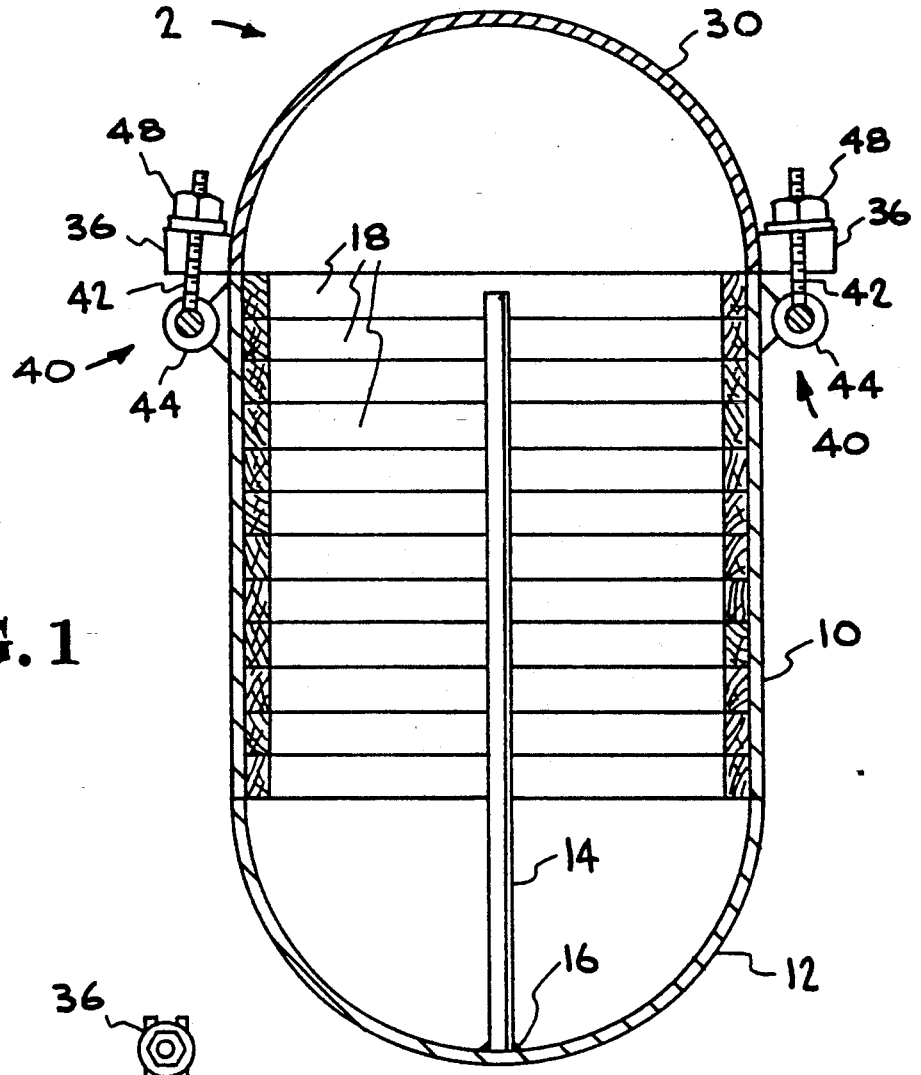
FIG. 1 is a vertical side-section view of one embodiment of the invention.

As best seen in FIG. 1, the inner surface of cylinder 10 is lined with a liner material 18 capable of absorbing the impact of shrapnel generated during a detonation. Preferably, liner 18 comprises 1" thick wood and may be constructed by gluing 1" wide and 1" thick rings or segments of wood to the inner surface of cylinder 10.

A domed cover member 30, having a handle 32, is removably mounted to the opposite end of cylinder 10 by hinges 34. Domed cover member 30 is also generally elliptical and preferably hemispherical in shape and may be identical to domed bottom 12. A series of quick-lock clamping assemblies 40, which are symmetrically spaced around the outer surface at the open end of cylinder 10, are used to secure cover member 30 to cylinder 10. Clamping assemblies 40, as best seen in FIGS. 3A and 3B, each comprise a threaded rod 42 that pivots on a hinge support 44 which is welded to cylinder 10.

To secure cover 30 to cylinder 10, each rod 42 is pivoted upward to fit between two corresponding lugs 36 on cover 30 which are spaced apart a distance just slightly greater than the diameter of rod 42. A washer 46 and a nut 48 on threaded rod 42 are then tightened against lugs 36.

Figure 3B:
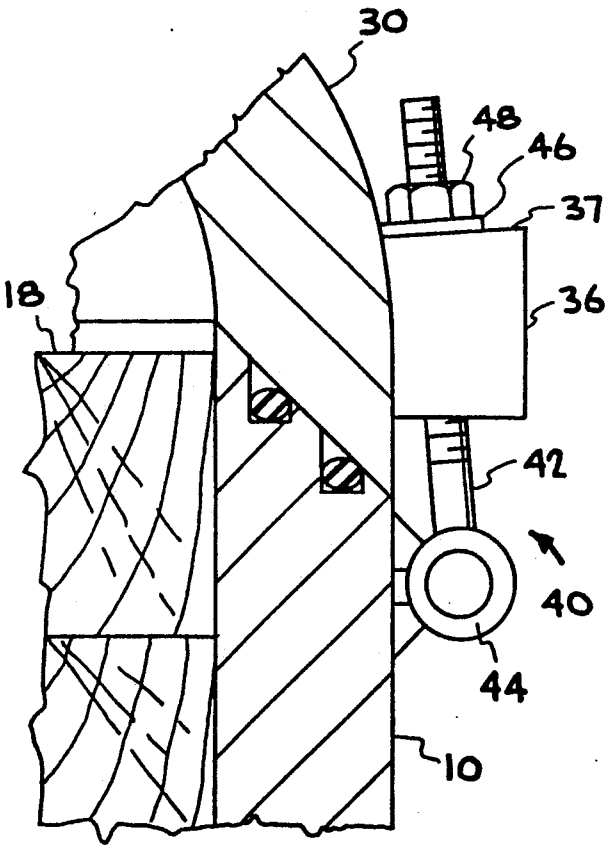
FIG. 3B is a fragmentary enlarged view of a portion of the clamping structure shown in FIG. 1, showing the clamping structure in a closed position.
Figure 3A:
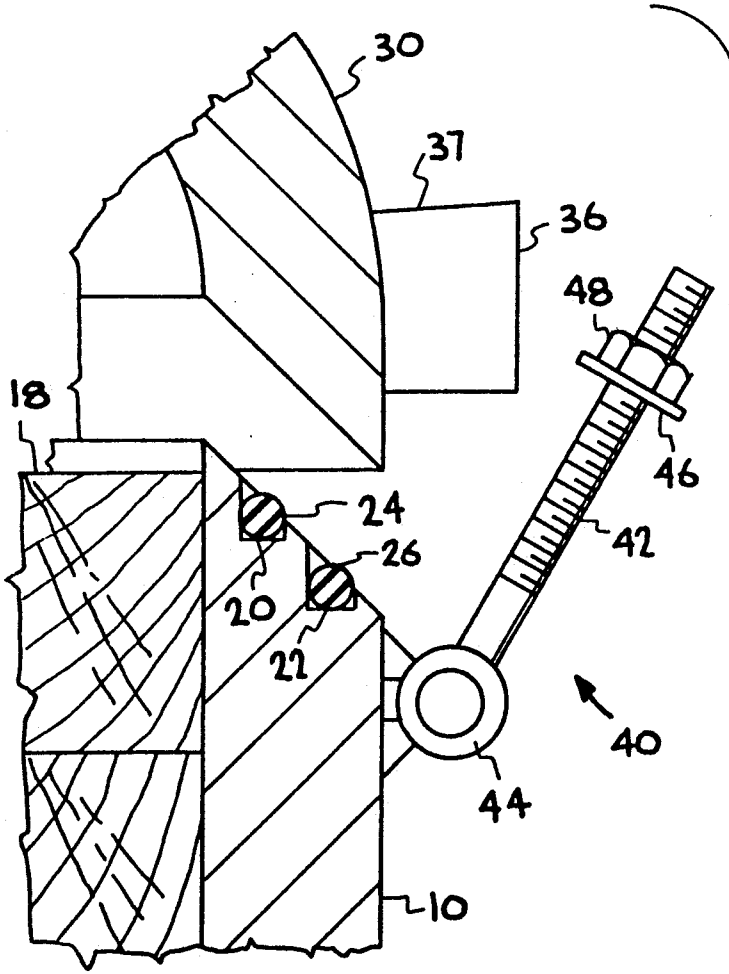
FIG. 3A is a fragmentary enlarged view of a portion of the clamping structure shown in FIG. 1, showing the clamping structure in an open position.

It will be noted, in FIGS. 3A and 3B, that the upper surface 37 of lugs 36 is slanted upward as it extends out from cover 30. This upward slant is deliberately provided to prevent or inhibit inadvertent slippage of washer 46 and nut 48 out of engagement with lugs 36.

To provide a seal between the top surface or lip of cylinder 10 and the bottom edge of cover 30, a pair of annular grooves 20 and 22 are formed in the top surface of cylinder 10 and a pair of O-rings 24 and 26 are respectively mounted in these annular grooves, as shown in FIG. 3A. Tightening of clamping assemblies 40 spaced around the periphery of cylinder 10 and cover 30 forces cover 30 into sealing contact with O-rings 24 and 26 and urges the O-rings respectively into annular grooves 20 and 22 to provide a gas-tight seal between cylinder 10 and cover 30.

Figure 2:
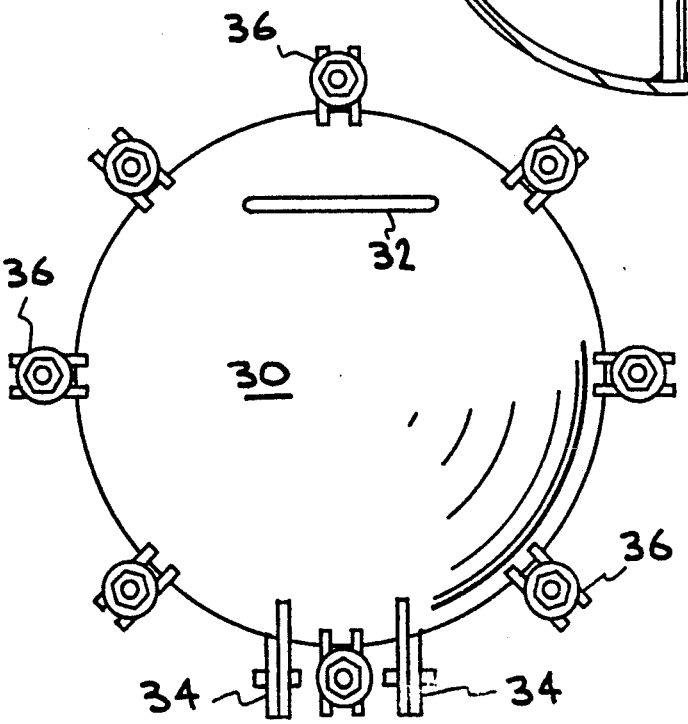
FIG. 2 is a top view of the embodiment shown in FIG. 1.

As shown in FIG. 2, clamping assemblies 40 are symmetrically spaced around cylinder 10 and cover 30 to provide an evenly spaced clamping force between cover 30 and cylinder 10 around the perimeter. The number of clamping assemblies, as well as the diameter of each rod 42 in each clamping assembly will provide means for controlling the amount of pressure buildup which can occur in the module during an inadvertent detonation before venting begins to occur by movement of cover 30 away from cylinder 10. Preferably, when cylinder 10 comprises a 24" diameter vessel, clamping mechanisms 40 will be spaced about 45° apart around the perimeter of module 2, i.e., eight clamping assemblies will be used, as depicted in FIG. 2. To decrease the response time to a detonation, as well as to permit a higher degree of venting, less clamping mechanisms should be used, e.g., the use of six clamping mechanisms spaced 60° apart around the periphery of cylinder 10. On the other hand, to increase the response time, the number of clamping mechanisms employed can be increased, e.g., the use of twelve clamping mechanisms space at 30° intervals around cylinder 10.

In operation, explosives are placed in the storage module 2, preferably contained on spools which may be placed on central shaft 14, and cover 30 is lowered over the top edge of cylinder 10. The threaded rods 42 of clamping mechanisms 40 are swung up into place between lugs 36 on cover 30 and nuts 48 are hand tightened, i.e., to about 2 ft.lbs., to urge cover 30 against the O-ring seals 20 and 22 on cylinder 10.

By only hand tightening nuts 48 on rods 42, an inadvertent detonation will permit cover 30 to separate sufficiently from cylinder 10 to permit the gases generated within module 2 to vent through the opening created between cylinder 10 and cover 30 by the pressure of the detonation. It should be noted, in this regard, that the higher the initial pressure generated in module 10 by the detonation, the greater will be the strain on rods 42, causing cover 30 to separate a greater distance from cylinder 10 to thereby provide an even greater opening which acts to relieve any pressure build-up in module 2.

In addition, the greater the initial pressure of the detonation and resultant separation of cover 30 from cylinder 10, the greater the opportunity for the pressure to blow out O-rings seals 20 and 22, thereby providing an additional measure of pressure relief in module 2.

In the embodiment just described, when cylinder 10 has an O.D. of about 24" and a height of about 24", and cylinder 10, domed bottom 12, and cover 30 are each constructed of ½ thick mild steel, the resulting containment vessel is capable of storing from about 1 to 2 pounds of Class 1.1 explosives without risk of sympathetic detonation of adjoining storage modules should the contents of the storage modules inadvertently detonate.

Generally speaking, to avoid such sympathetic detonation, the storage container should be sized to prevent overloading of the container with an excessive amount of explosives. Therefore, in accordance with a preferred embodiment of the invention, the cylindrical storage body should have an outer diameter which does not exceed about 121.92 cm. (4 ft.), a height not exceeding about 182.88 cm. (6 ft.), and a wall thickness of not less than about 1.27 cm. (0.5").

Turning now to FIGS. 4 and 5, another embodiment of the invention is shown wherein cover 130, which is hinged at 134 to cylinder 110, is centrally secured in a sealing relationship to cylinder 110 via threaded central shaft 114 which extends out beyond the top of cylinder 110. Shaft 114, which may range in diameter from about 2 cm. to about 10 cm., is secured within cylinder 110 similarly to the securement of shaft 14 within cylinder 10, i.e., welded to domed bottom 112 secured to cylinder 110. However, threaded shaft 114, unlike shaft 14, is long enough to protrude through an opening 128 in cover 130. An internally threaded handwheel 150 is threaded on shaft 114 to centrally urge cover 130 against the edge of cylinder 110. O-ring seals, such as shown in FIG. 3A are also used in the same manner in this embodiment, to seal cover 114 to cylinder 110.

In this embodiment, an inadvertent detonation of the contents of module 102 will result in a pressure or force buildup against cover 130 which will, in turn, create a tensile stress on central shaft 114 causing it to lengthen, resulting in an opening of the peripheral seal between cover 130 and metal cylinder 110. Thus a small elongation of shaft 114 will result in a rather large total opening or venting since the opening created thereby will extend around the entire perimeter of the interface or seal between cover 130 and cylinder 110.

The size of the vent opening, for a given quantity of explosives being detonated, can be adjusted by changing the diameter of the threaded shaft (with a larger diameter shaft providing more resistance against lengthening); by changing the material used for shaft 114; or by changing the strength of a shaft constructed of a given material of given thickness, for example, by a heat treatment of the shaft.

Turning now to FIG. 6, another embodiment of the invention is illustrated which comprises the best mode of the invention and constitutes a combination of the two previously described embodiments. A series of quick-lock clamping assemblies, which include lugs 236 on cover 230 and nuts 248 on rods 242, as previously described and illustrated with respect to the first embodiment, are peripherally spaced around cover 230 to peripherally secure cover 230 to a cylinder constructed similarly to cylinder 110, i.e., the same cylinder may be utilized by adding the quick-lock clamping mechanisms.

Additionally, however, in this embodiment, central threaded shaft 214, which is welded to the domed bottom of the cylinder as in the earlier embodiments, passes through an opening in cover 230 and is engaged by centrally threaded handwheel 250 to provide a central clamping force between cover 230 and the underlying cylinder.

In using this embodiment, the extent and timing of the venting of the module may be controlled by the diameter, material, and strength of the rod, as in the embodiment of FIGS. 4 and 5, with clamping assemblies 240 acting merely as a safety restraint in the unlikely event that central shaft 214 would shear or rupture. Clamping assemblies 240 are, therefore, preferably only loosely attached with sufficient force so as to prevent inadvertent dislodgement during transit. The outward slant of the upper surface lugs 236 upward, as previously described with respect to surface 37 of lugs 36 in FIG. 3A, will act to prevent such slippage even though nuts 248 are only loosely tightened.

It should be noted that for any of the above described embodiments, the amount of tightening of the peripheral clamping mechanisms; and/or the diameter, material, or strength of the central threaded shaft, and tightness of the central handwheel on the threaded shaft should be such that there will be a maximum of not more than about 4 milliseconds after the detonation before the structure reaches its maximum venting position, and the total venting of the structure should be accomplished within from about 8 to about 10 milliseconds.

By the provision of a standard storage module for explosives of a given size, e.g., a 24" diameter cylinder of about 24" length, additional quantities of explosives may be stored in a second similar sized container more safely than by increasing the dimensions of the storage module to accommodate a larger storage capacity, because the storage of amounts of explosives in excess of from about three to about six lbs would require the use of much larger containers with much thicker walls. In other words, a doubling of the amount of explosives stored would result in the need for a storage container of much more than twice the dimensions, as well as a much thicker walled container.

Generally, for a storage module of about ½" steel wall thickness, the total volume of the container should not exceed about 50,000 cubic inches. The use of a storage module not exceeding such dimensions should be capable of the safe storage of up to about six pounds of explosives, without risk that a detonation of the contents would result in sympathetic detonations in adjoining storage modules.

To illustrate the invention, a storage module such as described and illustrated in FIGS. 1–3A and 3B was constructed using a 24" O.D. steel cylinder of 24" length comprising ½" thick steel walls, with the domed cover secured to the cylinder using eight clamping mechanisms spaced at 45° intervals around the cylinder. A combination of 7, 13, 20, 30, and 50-grain/ft. MDF and FLSC strands were placed on four 9.5" diameter 6" wide spools which were placed end for end on the central shaft to make a 2' long continuous wood cylinder. The combination of MDF and FLSC sizes was chosen to duplicate as closely as possible the ratio of lead to explosive weights found in a 15 grain/ft. FLSC. The total explosive weight in the charge was 5180 grains (0.74 lbs.) and the lead weight was 7.4 lbs. The MDF and FLSC strands were run parallel to the axis of the spools and gathered into six separate bundles at the cover end. Each bundle was then attached to a Primacord lead and the leads were bundled together to be detonated simultaneously by a single detonator.

A second container, identical to the first, was loaded with a 5180 grain charge consisting of 18-grain/ft. of Primacord strands wrapped around four identical spools placed end to end. No lead was used in this case, however. The charge was arranged to be detonated by six Primacord strands that were run axially and bundled together for simultaneous detonation by a single detonator.

The two containers were placed one foot apart on a steel table and a number of pressure gauges were arranged on stands at various distances from the two containers, the closest being four feet from the containers. When the first charge was detonated, no sympathetic detonation occurred in the second container, despite its proximity. When the first container was opened and examined, the steel rod in the center of the container was damaged, and the debris produced by the wood spool and the MDF and FLSC lead jackets were piled at the bottom of the cylindrical part of the container. The wood liner was pitted by the lead debris, but had not been pulverized.

The second charge was then detonated and the pressure gauges were observed for detection of pressure or shock waves. None registered on even the gauge located within four feet of the container. The design of the container allowed the gas to leak out slowly enough to produce no measurable air blast. However, it was noted that one of the O-rings had been pushed out, indicating that an escape path for the gaseous detonation products had been created by the flexure of the cover.

Figure 7:
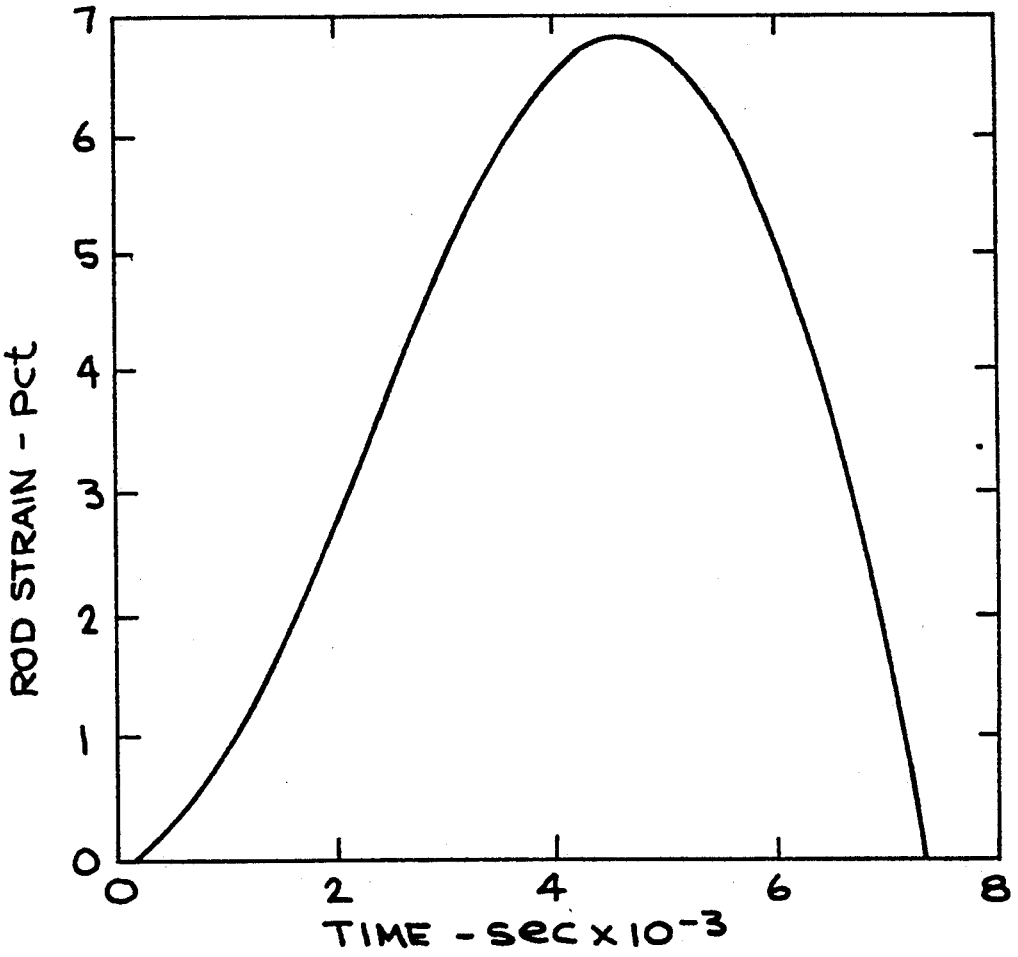
FIG. 7 is a graph which plots the strain on the central rod (which controls the extent of the pressure-relieving opening of the lid) versus time after a detonation.

A test was also conducted using the design of the second embodiment of the invention, i.e., wherein a central threaded shaft which passes through the cover is centrally engaged by a handwheel. FIG. 7 shows the strain history for a 5-cm-diameter threaded rod made from a high-strength (6.9 kb yield) following the detonation of a 1000-grain HE charge inside the container. The maximum rod strain was 6.8% which is less than half the 15% failure strain expected for the type of steel the rod was made from.

Thus, the storage module for explosives of the invention provides a containment vessel which is designed to be self venting with the amount of venting proportional to the size or amount of the detonation, by flexure of the cover relative to the container body, to provide an escape path between the cover and the container body for gases generated by the detonation. Furthermore, the pressure venting mechanism of the invention inhibits the occurrence of sympathetic detonation of other storage modules stored adjacent the detonated module.

Having thus described the invention what is claimed is:

1. A storage container for explosives comprising:
a cylindrical storage body having an inner surface and an outer surface;
a cover; and
clamping means for retaining said cover to said storage body comprised of a first member and attachment means for interconnecting said first member to both said storage body and said cover;
wherein said clamping means have a predetermined tensile strength such that such that an increase in pressure within the storage container resulting from a detonation of predetermined magnitude within the container will create a stress in the clamping means that will permanently lengthen said first member by plastic deformation, without breaking said clamping means, to a dimension whereat said clamping means retain said cover to said body while permitting the formation of a passage between said body and said cover for the venting of pressure produced by said detonation within the container; and
wherein said lengthening of said first member and the size of said passage permitted by said lengthening are proportional to said detonation of explosives within the container for detonations of magnitudes within a predetermined range; and
the container further includes a wood liner on said inner surface of said cylindrical body for absorbing sufficient energy from shrapnel generated during a detonation so that said shrapnel will be retained within said storage container.

2. The storage container of claim 1 wherein said first member comprises a central threaded member within said storage body that passes through an opening in said cover and is adapted to be engaged by an internally threaded member for urging said cover against said storage body.

3. The storage container of claim 1 wherein said storage body is a cylindrical storage body having a periphery, said clamping means comprises a plurality of clamping means disposed around said periphery of said cylindrical storage body, and each of said plurality of clamping means are comprised of a first member and attachment means for interconnecting said first member to both said storage body and said cover.

4. The storage container of claim 1 wherein:
said storage body comprises a cylindrical storage body having a dome shaped end;
said cover comprises a dome shaped cover; and
the storage container further includes at least one O-ring seal provided between said cover and said storage body.

5. The storage container of claim 4 further including a central shaft within said storage body capable of centrally supporting explosives thereon.

* * * * *